US006746202B2

(12) United States Patent
Mader et al.

(10) Patent No.: US 6,746,202 B2
(45) Date of Patent: Jun. 8, 2004

(54) METHOD AND ARRANGEMENT FOR THE PRODUCTION OF CROSSED STACKS

(75) Inventors: Carl Conrad Mader, Hinwil (CH); Erwin Muller, Dürnten (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/344,909

(22) PCT Filed: Aug. 13, 2001

(86) PCT No.: PCT/CH01/00496

§ 371 (c)(1),
(2), (4) Date: Feb. 18, 2003

(87) PCT Pub. No.: WO02/14194

PCT Pub. Date: Feb. 21, 2002

(65) Prior Publication Data

US 2003/0185663 A1 Oct. 2, 2003

(30) Foreign Application Priority Data

Aug. 18, 2000 (CH) ..... 1613/00

(51) Int. Cl.[7] ..... B65H 29/02

(52) U.S. Cl. ..... 414/788.3; 414/791.2; 414/791.3; 271/186; 271/204; 271/300

(58) Field of Search ..... 414/788.3, 791.3, 414/791.2; 271/300, 298, 186, 204, 213, 218, 69

(56) References Cited

U.S. PATENT DOCUMENTS

| | | | | | |
|---|---|---|---|---|---|
| 466,143 | A | * | 12/1891 | Shenk | 402/69 |
| 3,006,258 | A | * | 10/1961 | Jochem | 414/788.3 |
| 3,166,206 | A | * | 1/1965 | Porter et al. | 414/802 |
| 3,477,591 | A | * | 11/1969 | Andersson | 414/788.3 |
| 3,946,879 | A | * | 3/1976 | Jensen | 414/791.2 |
| 3,970,202 | A | * | 7/1976 | Speggiorin et al. | 414/788.3 |
| 4,155,133 | A | * | 5/1979 | Timson | 412/2 |
| 4,214,743 | A | * | 7/1980 | Meier | 271/182 |
| 4,320,894 | A | * | 3/1982 | Reist et al. | 271/277 |
| 4,838,747 | A | * | 6/1989 | Morisod | 414/790.3 |
| 5,007,629 | A | * | 4/1991 | Eberle et al. | 271/277 |
| 5,110,116 | A | * | 5/1992 | Kobler et al. | 271/277 |
| 5,201,513 | A | * | 4/1993 | Mion | 271/180 |
| 5,346,206 | A | * | 9/1994 | Steinhart | 271/305 |

(List continued on next page.)

FOREIGN PATENT DOCUMENTS

| | | |
|---|---|---|
| CH | 539 569 | 9/1973 |
| DE | 27 52 513 A1 | 4/1979 |
| EP | 0 854 105 A1 | 7/1998 |
| GB | 966402 | 8/1964 |

OTHER PUBLICATIONS

WO 99/33731, Conveyor System, Publication Date: Jul. 8, 1999.

*Primary Examiner*—Douglas Hess
(74) *Attorney, Agent, or Firm*—Rankin, Hill, Porter & Clark LLP

(57) ABSTRACT

Flat objects (7) to be stacked in a stacking device (2) are supplied serially, individually held and aligned with one another. Cross stacks (12) are produced by subjecting alternating groups (11, 11') of the supplied objects (7) to one of two step sequences, wherein, in both step sequences, the objects of the groups are released from held conveyance and are, in at least one of the step sequences, brought to the stacking device lying on a conveying surface (10.1, 10.1') in an imbricated formation. In the two step sequences, a rotation difference of 180° around an axis perpendicular to the object surfaces is established between alternating groups (11, 11'). The objects (7) positioned in the stacking device in groups form a cross stack (12), without requiring the stacking device (2) or parts thereof to be rotated between groups of objects being positioned. This results in shorter cycle times and in a smaller number of moving parts. The stacking system is suitable in particular for producing cross stacks (12) made up of rectangular or square, folded printed products.

20 Claims, 6 Drawing Sheets

U.S. PATENT DOCUMENTS 5,353,576 A * 10/1994 Palamides et al. ..... 53/540
5,370,382 A 12/1994 Wetter
5,971,697 A * 10/1999 Ballestrazzi et al. ..... 414/788.3
6,048,165 A * 4/2000 Karhumaki ..... 414/791.3
6,139,252 A 10/2000 Honegger
6,270,076 B1 * 8/2001 Reist ..... 271/302
6,325,592 B1 * 12/2001 Meier ..... 414/790.5
6,357,574 B1 3/2002 Eberle et al.
6,453,645 B1 * 9/2002 Suokas et al. ..... 53/446
6,612,563 B1 * 9/2003 Noll, Jr. ..... 271/69
6,619,651 B2 * 9/2003 Mader ..... 271/82
6,669,192 B2 * 12/2003 Reist ..... 271/225

* cited by examiner

METHOD AND ARRANGEMENT FOR THE PRODUCTION OF CROSSED STACKS

BACKGROUND OF THE INVENTION

1. Field of the Invention

The invention is situated in the field of materials handling technology and it concerns a method and arrangement for producing cross stacks made up of serially supplied, flat objects, in particular of printed products, such as, for example, newspapers or periodicals.

2. Description of Related Art Group

In a stack of flat objects all having approximately the same shape, the objects are lying substantially parallel to one another, directly adjacent to one another and they are aligned with one another (same edges of all objects are parallel to one another), such that the stack has the same base area as each individual object. Stability and handling of such stacks is very much dependent on the uniformity of the thickness of the objects over their flat expanse. Objects that have a regular thickness can be stacked in a more stable manner than objects comprising thicker and thinner areas. Stack instabilities resulting from irregular object thicknesses can be avoided for specific object forms by aligning the objects within the stack not in the most restrictive sense, but in such a manner that edge zones of differing thickness are positioned on top of one another, so that the stack being produced obtains an as equal as possible height on all sides and the objects in it are aligned as parallel with one another as possible.

An example of flat objects with non-uniform thickness, which can be stacked in stable stacks by the method mentioned above, are folded printed products with a rectangular or square shape. Products of this type are usually stacked in so-called cross stacks, i.e., on a first stacked group of products having an equal orientation (same edges are superimposed) a second group of products again having an equal orientation is positioned such that the same edges of the products of the first and second groups are located opposite one another and that the thickest product corners in the first and second group are lying diagonally opposite one another. On to the second group a third group of products having the same orientation as the products of the first group is stacked, and so on. The products of neighbouring groups are therefore rotated relative to one another by 180° around an axis perpendicular to the product surfaces (stacking axis).

For stacking, printed products are, for example, transported in an imbricated formation loosely lying on a conveyor belt, in which the leading product edges are positioned on top, towards a stacking shaft, which is open on top, and then one product after the other is pushed over the stacking shaft opening. Depending on the design of the shaft, the products are pushed directly onto a stacking table, onto a stack being produced, or drop from the stacking shaft opening onto the stacking table or stack. It is also known to convey the printed products again in an imbricated formation, but individually held on their leading edges, toward the stacking shaft, to pull them over the shaft opening, and to then release them.

For producing cross stacks, usually the stacking shaft or stacking table is rotated by 180° around a vertical rotation axis (stacking axis) after deposition of each group of products (stack section or layer). During rotation of the stacking shaft, the products continuing to be supplied are usually stacked on an auxiliary table. The auxiliary table is lowered after the rotation and is then laterally removed from the stack. All the same, product supply has to be briefly interrupted between each two individual groups (for re-positioning the auxiliary table). For rotating the stacking shaft, for interrupting the product supply, and for positioning of the auxiliary table many moving parts are necessary, which renders the corresponding devices complicated and increases maintenance. Examples of such stacking methods are described in the publications CH-539569, DE-2752513 (or GB-1568752) or EP-0586802 (or U.S. Pat. No. 5,370,382).

According to the method described in the publication EP-0854105 (or U.S. Pat. No. 6,139,252), a first stream of individually held printed products, which are all oriented in the same way, is transformed into a second stream of individually held printed products, wherein the printed products in the second stream are rotated by 180° and held on opposite edges in alternating groups, i.e. the products of the second stream are arranged in the same way as in a cross stack. The stream transformation is implemented by transferring the products of every second group to grippers of an auxiliary conveying system, by rotating the transferred products by conveying them along the twisted conveying path of the auxiliary conveying system, and by transferring the rotated products to the original conveying system gripping the products on an edge situated opposite the originally held edge. The products of the other groups are not transferred to the auxiliary conveying system and are, therefore, not rotated. Producing cross stacks from products supplied in a such transformed product stream is obviously significantly simpler than producing cross stacks from products being supplied having all the same orientation. However, stream transformation as described above sets high demands with respect to the equipment required and with respect to the alignment and synchronization of the conveying systems co-operating for the product transfer.

SUMMARY OF THE INVENTION

An object of the invention is to create a method and an arrangement for producing cross stacks from flat objects, in particular from printed products, being supplied serially and individually held gripped and all having the same orientation. The method and the arrangement are to be completely independent of whether the cross stack sections or stack layers (groups of objects) are large or small (if so required only comprising one product), and also independent of whether these stack sections have a uniform or a varying size. The method is to be simple and it has to make short cycle times possible. The arrangement is to be simple and to comprise as few moving parts as possible. The method and arrangement are to function without the necessity of temporarily taking over the objects by further grippers of an auxiliary conveying system such that the above mentioned alignment and synchronization difficulties are prevented.

According to the invention, the flat objects have a shape suitable for cross stacking (for example, folded, rectangular or square printed products) and are supplied for stacking individually held, behind each other and all having the same orientation. The flat objects are subjected in alternating groups to a first step sequence or a second step sequence prior to being positioned on a stack being produced. The two step sequences differ from one another such that a cross stack is produced when the alternating groups are positioned in a stacking device. This means that, prior to being positioned in a stacking device, the objects supplied serially and all oriented the same are handled differently in alternating groups in such a different manner, that after such handling they can be stacked in a cross stack without any further measures. The cross stack comprises the alternating groups of objects as stack sections, wherein in two neighbouring stack sections the objects are rotated by 180° around the stacking axis (perpendicular to the object surfaces).

Of the two step sequences mentioned:

both comprise a release step, in which the objects are released from being held gripped, wherein for at least one of the step sequences the release step comprises transferring the objects from held conveyance to lying conveyance in an imbricated formation (i.e. imbricated stream on a conveying surface or between two co-operating conveying surfaces) and wherein for the other step sequence the release step may comprise positioning the objects directly into a stacking device; and, together the two comprise rotation steps, which differ such that between objects having undergone the first step sequence and objects having undergone the second step sequence there is a rotation difference of 180° around an axis perpendicular to the object surfaces.

The rotation steps producing the required rotation difference are to be carried out correspondingly differently in the two step sequences and they may comprise:

rotating the objects during held conveyance;

transferring the objects from held conveyance to lying conveyance and rotating them simultaneously; and, rotating the objects during the lying conveyance.

A rotation difference of 180° around an axis perpendicular to the object surfaces can be implemented by a rotation step in one of the step sequences only. It can also be implemented as two partial rotations, which are carried out in opposite directions in both of the two step sequences. The rotation difference may also be implemented as combined rotations each by 180° around two axes parallel to the object surfaces and perpendicular to one another, wherein once again each individual one of the two rotations can be carried out as a complete rotation in one step sequence or as two partial rotations in the two step sequences.

The stacking device advantageously used for the method according to the invention is a stacking shaft to which, if so required, products can be supplied from two opposite directions and/or on two stacking levels located one above the other.

BRIEF DESCRIPTION OF THE DRAWINGS

The method in accordance with the invention and exemplary embodiments of the arrangement according to the invention are described in detail on the basis of the following drawings, wherein:

(FIG. 4: complete rotation during held conveyance by means of a twisted conveying track; FIG. 5: complete rotation during held conveyance by means of rotation of a rail section);

DETAILED DESCRIPTION OF THE PREFERRED EMBODIMENTS

Figure 1:
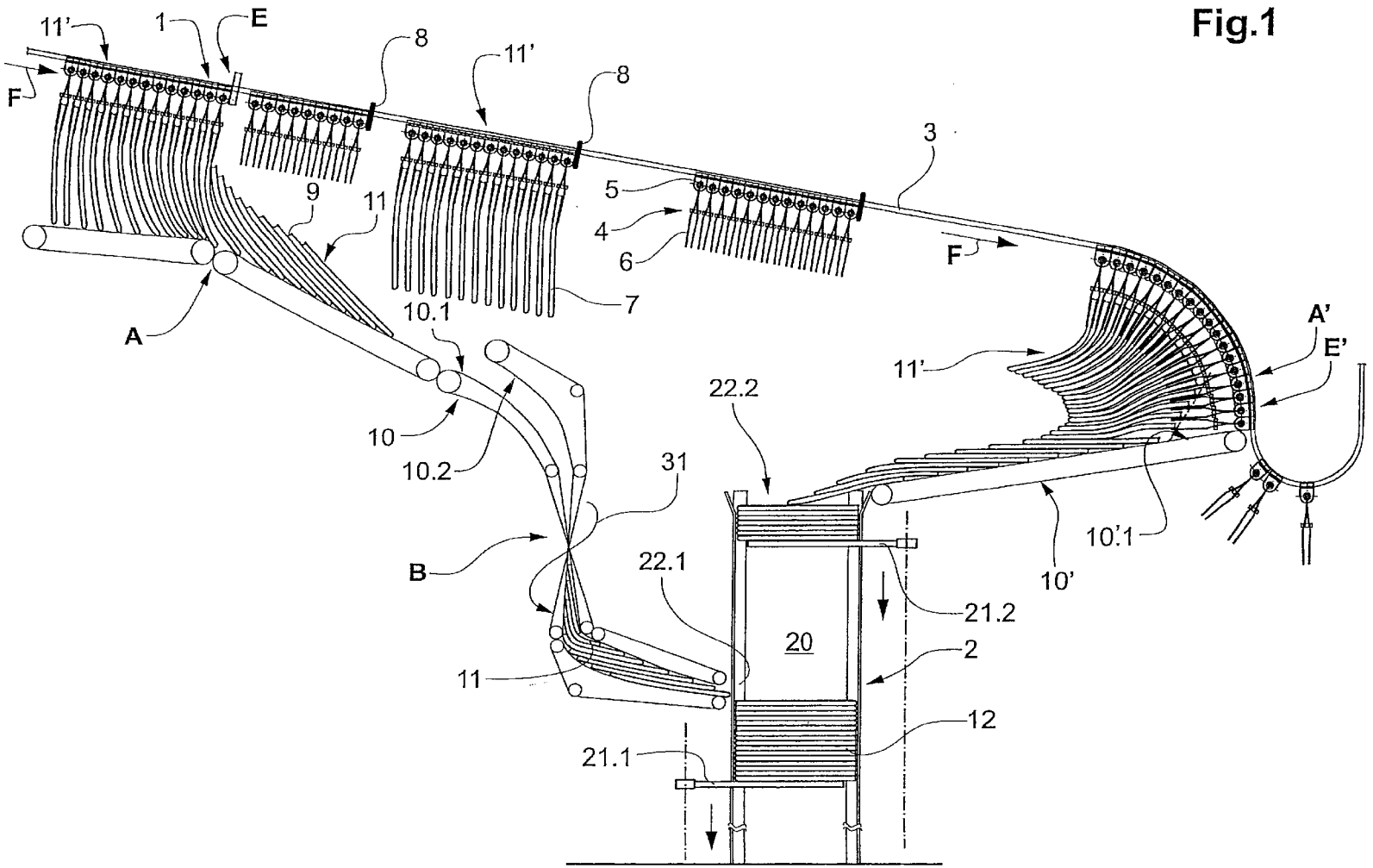
FIG. 1 shows an exemplary embodiment of the method according to the invention comprising rotations around two axes parallel to the object surfaces (partial rotations during the release step in both step sequences and complete rotation during lying conveyance in one step sequence)

FIG. 1 illustrates a first exemplary embodiment of the method according to the invention on the basis of a very schematically illustrated arrangement. This arrangement comprises a supply system 1, a stacking device 2 and two conveying devices 10 and 10', each comprising conveying surfaces and being arranged between two release points E and E' of the supply system 1 and the stacking device 2 (conveying device 10 comprising two conveying surfaces 10.1 and 10.2, conveying device 10' comprising one only conveying surface 10'.1). Control means (not illustrated) for selectively releasing groups of articles 7 from held conveyance are provided at the release points E and E'. Every second group 11 is released at the first release point E, the other groups 11' are released at the second release point E'.

The supply system 1 is, for example, a system as described in the publication WO-99/33731. This system comprises a stretch of rail defining a conveying track 3 and holding elements 4 individually movable along the stretch of rail. The holding elements 4 each comprise a roller or sliding element 5, which rolls or slides along the stretch of rail or the conveying track 3, respectively, and a gripper 6 for holding one object 7. The grippers 6 are designed to be closed for gripping an object and opened for releasing the gripped object by suitable control means (not illustrated). The holding elements 4 are driven along the conveying track 3 by the force of gravity (conveyance along a stretch of rail sloping downwards in conveying direction F) or they are magnetically coupled to a conveying organ running parallel to the conveying track 3 (not illustrated). For forming groups (11 and 11'), in particular in the case of an operation exploiting gravity as a drive, braking or stopping elements 8 are to be provided, behind which one group of holding elements 4 or of objects 7, respectively, is banked up.

The supply system 1 may also be implemented using an endless circulating conveying chain with grippers 6 being arranged on the chain at regular distances between one another. For the embodiment illustrated in FIG. 1, it is not necessary that there are greater distances between the groups 11 and 11' than between the holding elements 4 within the groups.

The conveying track 3 of the supply system 1 runs in conveying direction F over the stacking device 2 or past the stacking device 2. The first release point E is situated before the stacking device 2, the second release point E' behind the stacking device 2. The conveying direction of the conveying device 10 is substantially the same as the conveying direction of the supply system. The conveying device 10' has a conveying direction substantially opposite to the conveying direction F of the supply system 1. The two co-operating conveying surfaces 10.1 and 10.2 of the conveying device 10 are twisted around one another.

The step sequence of groups 11 is: release in E, rotation step A during release by 90° in a counter-clockwise direction around an axis parallel to the held edges 9, rotation step B during lying conveyance (twisting conveying track 31) by 180° around an axis parallel to the object surfaces perpendicular to the held edges 9. The step sequence of groups 11' is: release in E' and rotation step A' during release in a clockwise direction around an axis parallel to the held gripped edges 9.

As from the first release point E, the conveying tracks and conveying speeds of groups 11 and 11' have to be adapted to one another and to the supply capacity such that the groups are able to be supplied to the stacking device 2 as continuously as possible.

For stacking, the objects of groups 11 and 11' are pushed into the stacking shaft 20 of the stacking device 2 from two opposite sides by the conveying surfaces 10.2 and 10'.1. As illustrated in FIG. 1, the stacking device 2 comprises advantageously two co-operating stacking units arranged one above the other: a lower stacking unit, advantageously comprising a stacking table 21.1 capable of being lowered and a lower, lateral stack opening 22.1 and an upper stacking unit comprising a stacking table 21.2 advantageously capable of being lowered and an upper stack opening 22.2. On the lower stacking table 21.1 a cross stack 12 is produced by pushing objects of groups 11 through the lower stack opening 22.1 directly onto the cross stack 12, and by deposition objects of groups 11' after being stacked on the upper stacking table 21.2 onto the cross stack 12 by lowering and removing the upper stacking table 21.2 between deposition of two successive groups 11.

Advantageously, there are two interchangeable stacking tables 21.1 and 21.2, one each for the upper and for the lower stacking unit, so that during lowering an already stacked group 11' the stacking of a further group 11' can be started, and so that during lowering a completed cross stack 12 and during its removal from the stacking shaft 20, formation of a further cross stack 12 can be started.

For forming cross stacks 12 from groups 11 and 11' in accordance with the method as illustrated in FIG. 1 it is also possible to supply the groups to an upper opening of the stacking shaft 20, i.e. at the same level, and to deposit the object groups 11 and 11' alternatingly in the stacking shaft 20 in an as such known manner.

As is evident from FIG. 1, the arrangement for implementing the method in accordance with the invention requires very few moving parts and no large masses, such as, for example, the stack being produced need to be accelerated and braked.

Figure 2A:
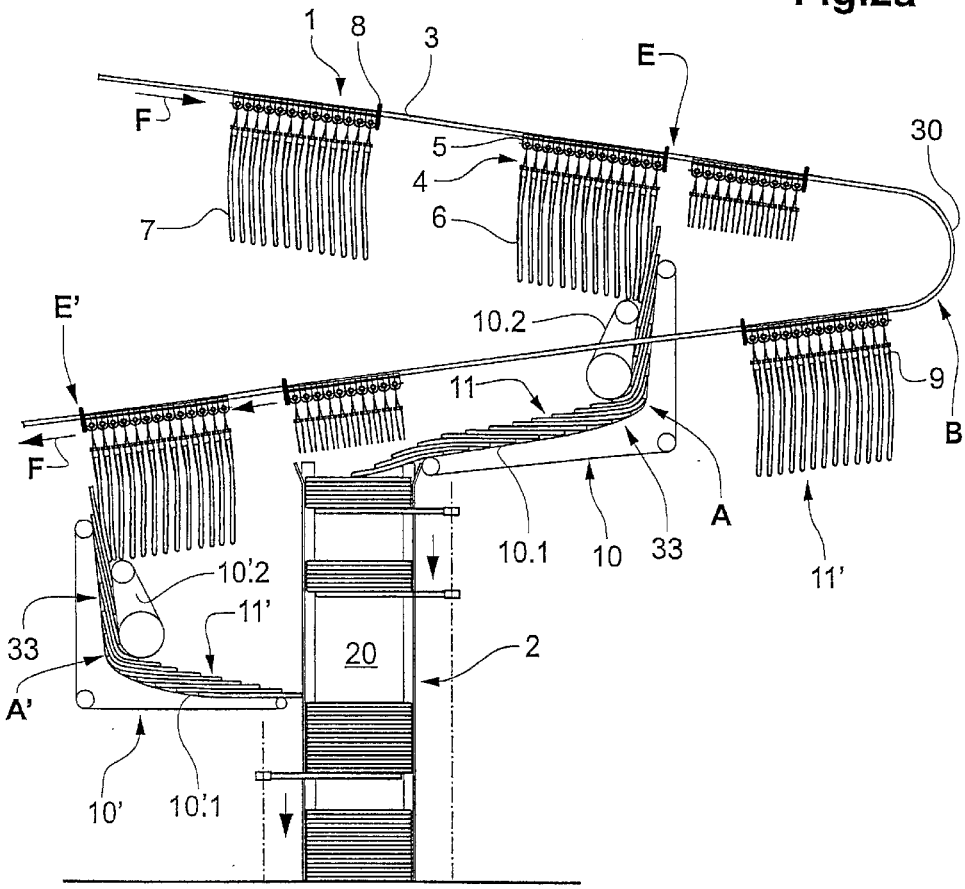
FIGS. 2*a* and 2*b* show a further, exemplary embodiment of the method in accordance with the invention with rotations around two axes parallel to the object surfaces (complete rotation during held conveyance in one step sequence and partial rotations during lying conveyance in both step sequences), viewed from the side (FIG. 2*a*) and from above (FIG. 2*b*)
Figure 2B:
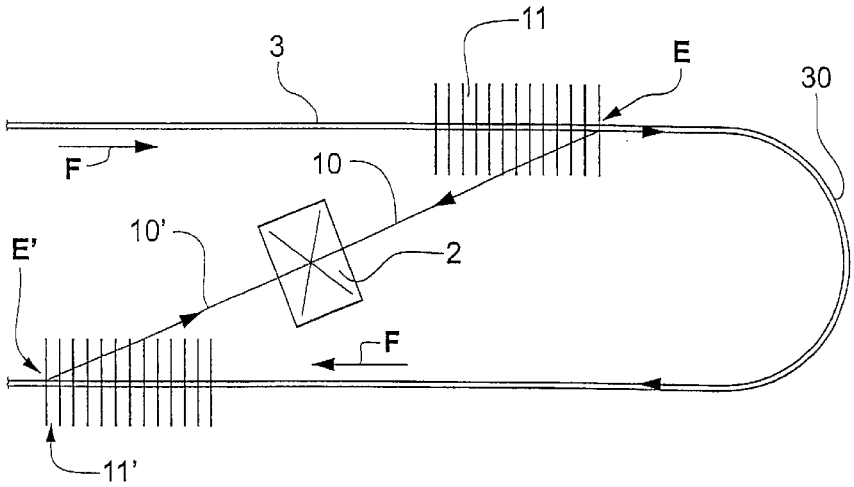

FIGS. 2*a* and 2*b* illustrate a further, exemplary embodiment of the method according to the invention on the basis of an arrangement, which once again is very schematically represented. It comprises essentially the same components as the arrangement illustrated in FIG. 1, which components are designated with the same reference numbers. The arrangement is viewed from the side in FIG. 2*a* and from above in FIG. 2*b*.

The conveying track 3 of the supply system 1 runs over the stacking device 2 or past the stacking device 2 before and after a conveying track loop 30 of 180° (rotation step B for groups 11' with a complete rotation during held conveyance), wherein the objects 7 of every second group (groups 11) are released before the loop 30 (first release point E) and the remaining objects (groups 11') after the loop 30 (second release point E') and they are transferred to the conveying devices 10 and 10'. Each conveying device 10 and 10' comprises two conveying surfaces (10.1, 10.2 and 10'.1, 10'.2) as well as a bend 33 from substantially vertical to essentially horizontal conveyance (rotation steps A and A' for groups 11 and 11' with partial rotations). The conveying devices 10 and 10' are both directed essentially against the conveying direction F of the supply system and lead to the stacking device 2 from opposite sides.

Figure 3A:
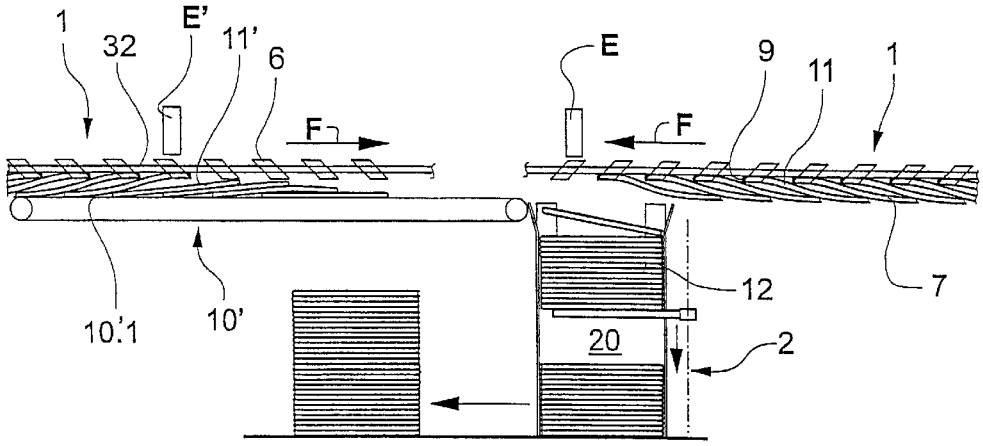
FIGS. 3*a* and 3*b* show a further, exemplary embodiment of the method according to the invention with a rotation around an axis perpendicular to the object surfaces (complete rotation during held conveyance by a conveying track loop in one step sequence), viewed from the side (FIG. 3*a*) and from above (FIG. 3*b*)
Figure 3B:
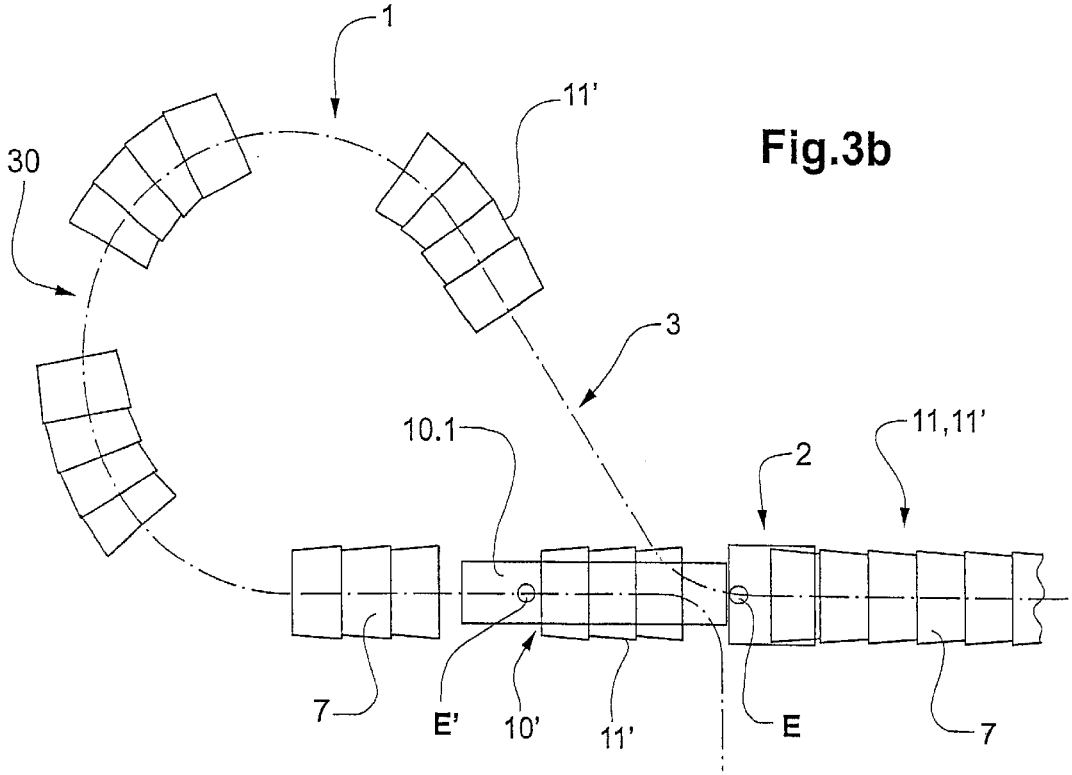

FIGS. 3*a* and 3*b* illustrate a further, exemplary embodiment of the method in accordance with the invention, once again on the basis of a very schematically illustrated arrangement, which in FIG. 3*a* is viewed from one side and in FIG. 3*b* from above. The arrangement comprises only one conveying device 10' with a conveying surface 10'.1 for groups 11', while groups 11 are positioned in the stacking device 2 directly from held conveyance by the supply system 1. The illustrated supply system 1 comprises an endless circulating transport chain 32 (only partially shown), which defines the conveying track 3 and on which grippers 6 are mounted with equal distances between one another. Held by these grippers 6, the objects 7 are conveyed in conveying direction F in a kind of imbricated formation, held gripped by their leading edges 9 which are positioned on top of the formation. The conveying track 3 first leads over the stacking device 2, where the first release point E is located. After a conveying loop 30, the second release point E' is provided where the conveying track of the supply system runs above the conveying device 10', which leads towards the stacking device 2.

The objects of groups 11 are released from held conveyance directly above the stacking shaft 20 and they are stacked without any rotation and without transfer to a conveying device with conveying surface. The step sequence assigned to these groups 11, therefore, contains only a release step. The objects of groups 11' are rotated by 180° around an axis perpendicular to the object surfaces by being conveyed around the conveying track loop 30 and are deposited on the conveying surface 10'.1 to be positioned in the stacking device 2 without any further rotation.

Figure 4:
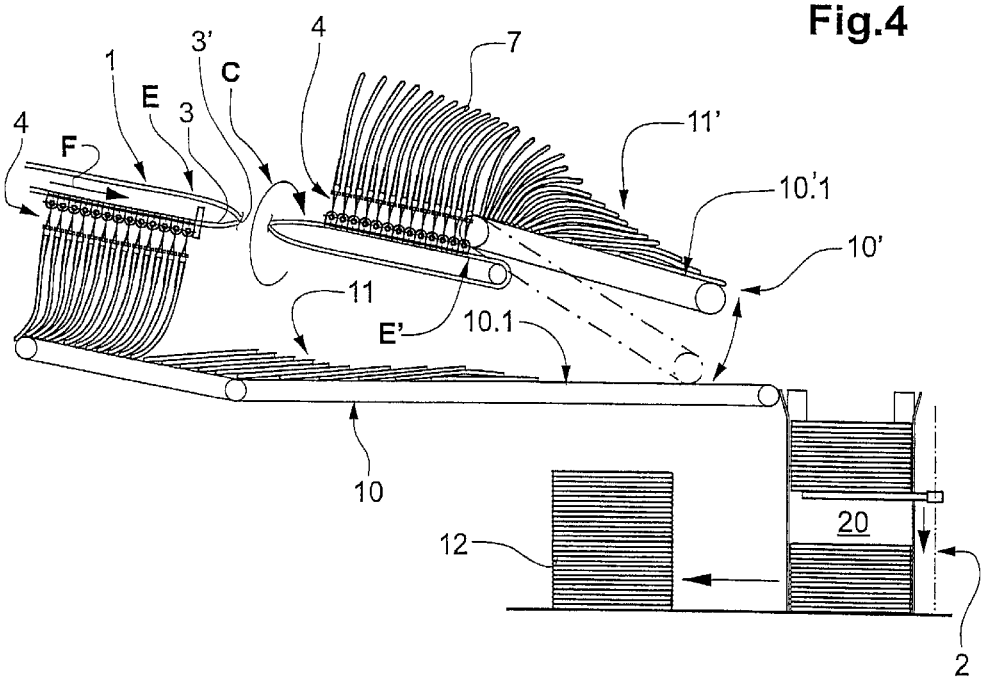
FIGS. 4 and 5 show two further, exemplary embodiments of the method in accordance with the invention with a rotation around an axis perpendicular to the object surfaces

FIG. 4 illustrates a further, exemplary embodiment of the method according to the invention on the basis of a further, schematically depicted arrangement. This once again comprises a supply system 1 and a stacking device 2 as well as a first and a second conveying device 10 and 10', each respectively with a conveying surface 10.1 and 10'.1. The supply system 1 advantageously comprises a stretch of rail defining the conveying track 3 and holding elements 4 that are individually movable along the stretch of rail. This stretch of rail comprises a twist 31, the first release point E being positioned in conveying direction F before the twist 31, and the second release point E' after the twist 31.

Groups 11' are rotated by 180° around an axis perpendicular to the object surfaces (rotation step C during held conveyance) by being conveyed through the twist of the conveying track. The rotations during release are the same for the objects in groups 11 and in groups 11' and, therefore, do not contribute to the rotation difference to be established.

The conveying surface 10'.1 of the second conveying device 10' is designed swiveling such that it can be lowered onto the conveying surface 10.1 of the first conveying device 10 and lifted off it. When the conveying surface 10'.1 is in its lowered position objects of groups 11' are transported from the conveying surface 10'.1 to the conveying surface 10.1 and from there to the stacking device. When the conveying surface 10'.1 is lifted, the conveying surface 10.1 of the first conveying system 10 is free for conveying a group 11 to the stacking device 2. If a stacking device 2 with two stacking units as described in connection with FIG. 1 is used, swiveling of the conveying surface 10'.1 is not needed and groups 11 and 11' can be stacked simultaneously or at least partially simultaneously.

Figure 5:
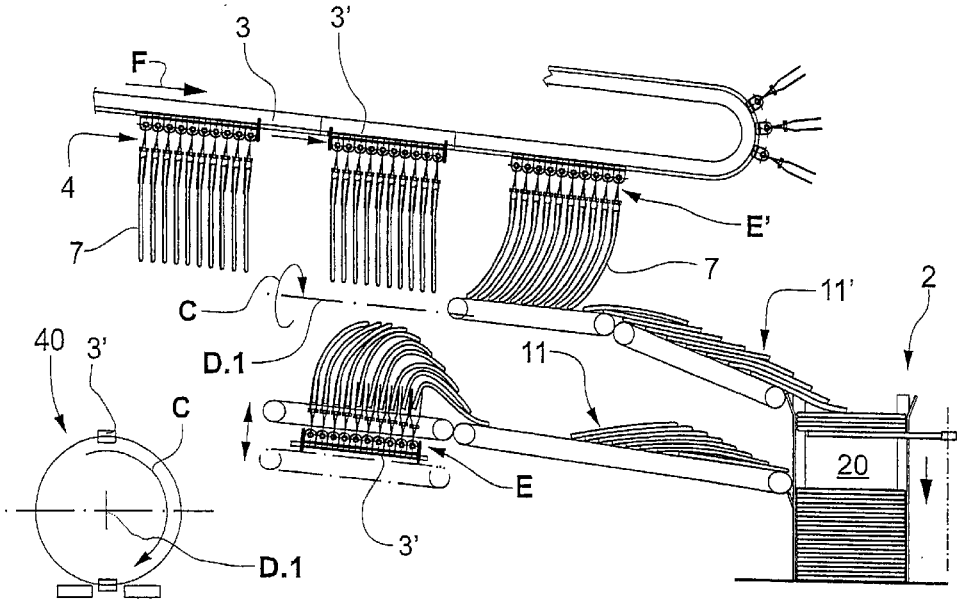

FIG. 5 illustrates a further, exemplary embodiment of the method in accordance with the invention on the basis of a further, schematically illustrated arrangement. The method coincides with the method according to FIG. 4 except for the rotation step C around an axis perpendicular to the object surfaces, which is implemented by a circular movement of a rail section 3' transverse to the conveying direction F (rotation axis D.1, parallel to the conveying direction F), as is made even more clear by the detail 40. Objects 7 or holding elements 4 respectively belonging to groups 11, are blocked on the displace able rail section 3', then the rail section 3' is rotated into the lower position and the objects are released (first release point E). Objects 7 or holding elements 4 respectively belonging to groups 11' pass the displace able rail section 3' without being blocked and without circular movement and are then released (release point E'). As illustrated in detail 40, there are advantageously two displace able rail sections 3', which are alternatingly positioned in the lower and in the upper position. In this manner it becomes possible to transport a group 11' across the rail section 3' to be released at the second release point E' while releasing a group 11 at the first release point E from the further rail section 3'.

The displace able rail section 3' of the arrangement of FIG. 5 renders it impossible to replace the supply system 1 with holding elements 4 that are individually movable along a stretch of rail by a supply system 1 with an endless transportation chain and grippers arranged on it (as is possible for the embodiments of FIGS. 1 to 4).

Figure 6:
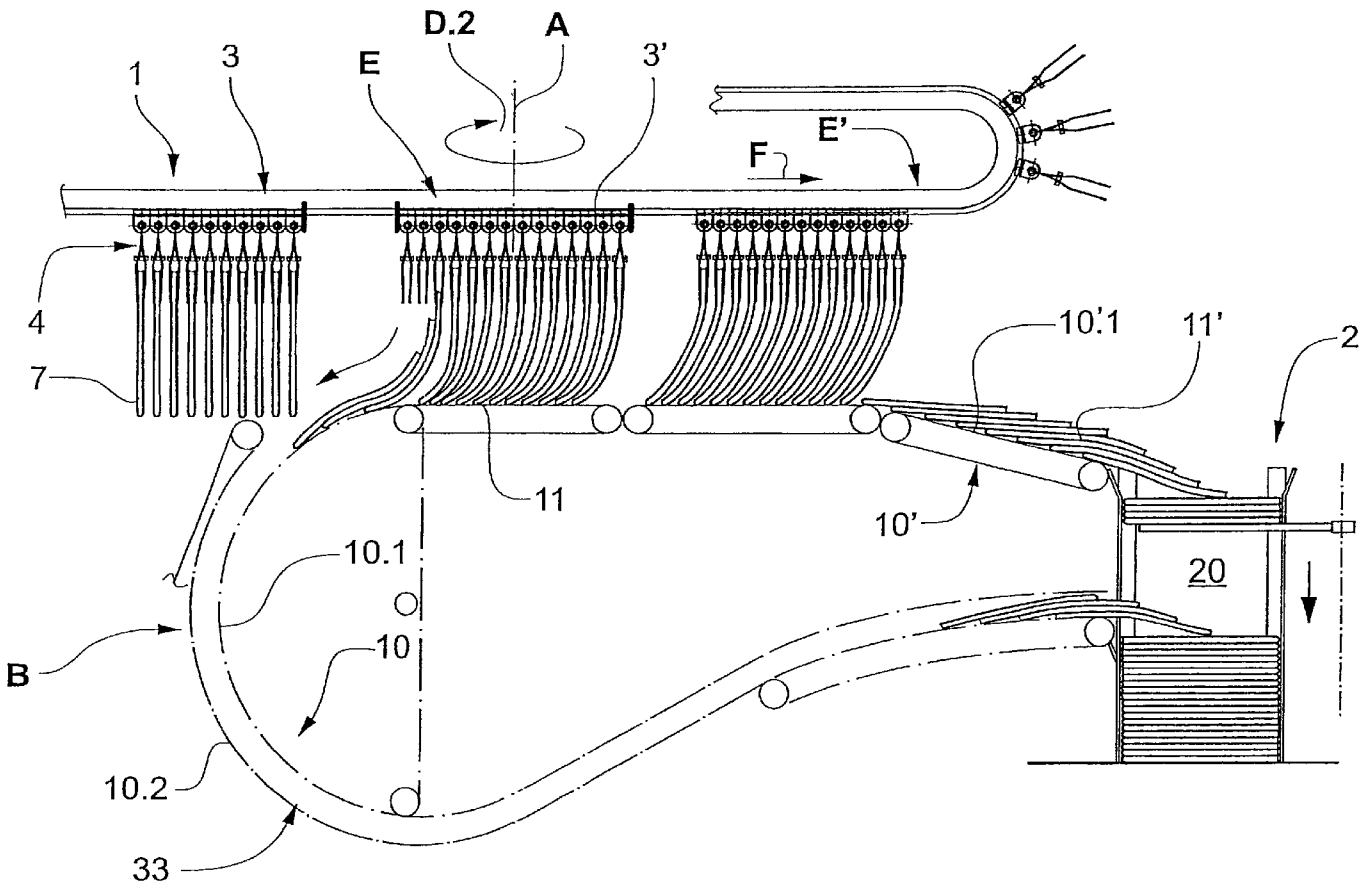
FIG. 6 shows a further, exemplary embodiment of the method according to the invention with rotations around two axes parallel to the object surfaces (complete rotation during held conveyance in one of the step sequences and complete rotation during lying conveyance in the same step sequence)

FIG. 6 illustrates a further, exemplary embodiment of the method in accordance with the invention on the basis of a once again very schematically depicted arrangement. Here too, a displace able rail section 3' is made use of, which, however, is rotated around a rotation axis D.2 perpendicular to the conveying direction F. Therefore, groups 11 are rotated around an axis parallel to the held edges of the objects 7 (rotation step A). The rotated groups 11 are then released between two conveying surfaces 10.1 and 10.2 of a first conveying device 10 (release point E). During lying conveyance in an imbricated formation around a bend 33 they are rotated once more (rotation step B with complete rotation, that is, by 180°, around a second axis parallel to the object surfaces).

Figure 7:
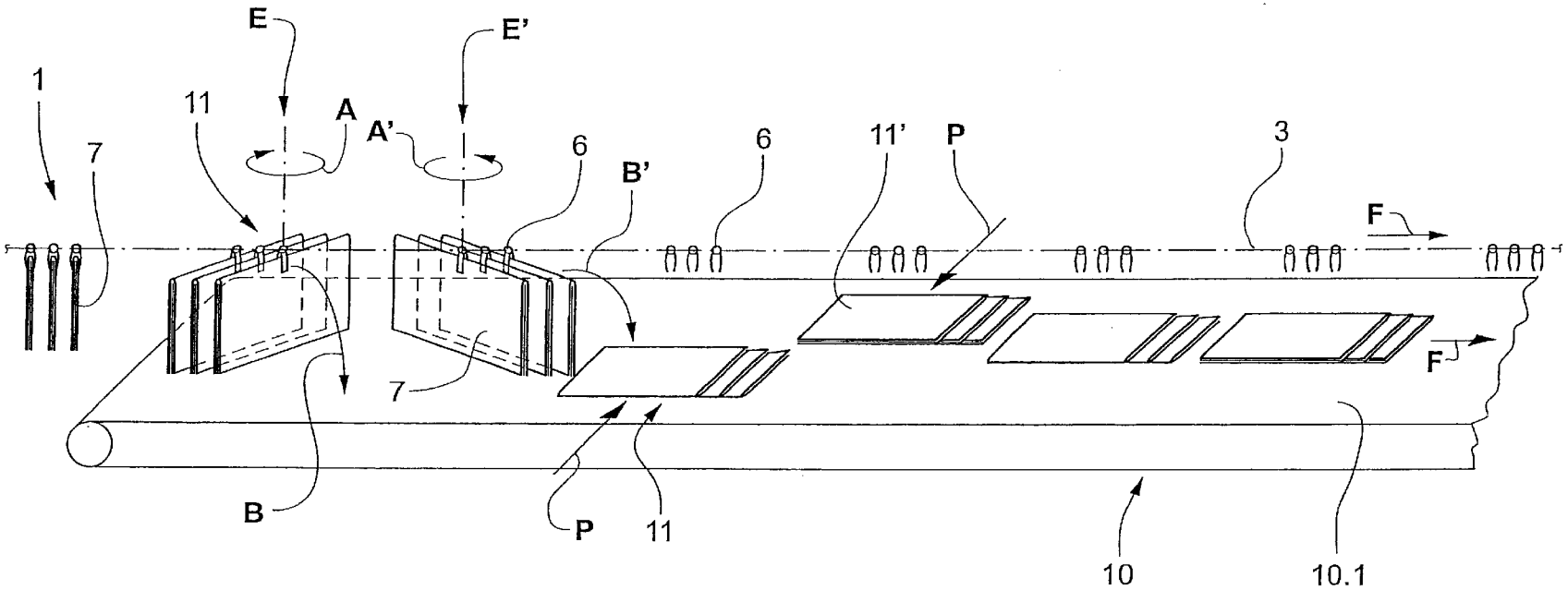
FIG. 7 shows a further, exemplary embodiment of the method in accordance with the invention with rotations around two axes parallel to the object surfaces (partial rotations during held conveyance in both step sequences and partial rotations during the release step also in both step sequences).

FIG. 7 illustrates a further, exemplary embodiment of the method according to the invention on the basis of a further, schematically illustrated arrangement. This arrangement also comprises a supply system 1 (stretch of rail with individually movable holding elements or traction organ with grippers 6 arranged on it), a conveying system 10 with conveying surface 10.1, and a stacking device (not shown). In contrast to the embodiments of the method in accordance with the invention, which have been described further above, in this case the objects 7 of all groups 11 and 11' are released from held conveyance at release points E and E', which if so required may coincide, by being deposited on to the same conveying surface 10.1. Prior to this deposition, the held objects 7 are rotated by rotation of the grippers 6 holding the objects 7 by substantially 90° relative to the conveying track 3 (rotation steps A and A' with partial rotations for groups 11 and 11' in opposite direction). During release from held conveyance, groups 11 are deposited in a direction opposite to the depositing direction of groups 11' (rotation steps B and B' with partial rotations). Following deposition, the groups have to be aligned on the conveying surface (arrows P), so that they form an aligned group stream, which in this form can be conveyed to a stacking device (not illustrated) directly.

Grippers 6, which are components of holding elements or are arranged on a traction organ and which are capable of being rotated relative to the conveying track 3 in the manner illustrated in FIG. 7, control means for controlling such gripper rotation (rotation steps A and A'), means for depositing objects 7 in different directions on the conveying substrate 10.1 (rotation steps B and B'), as well as means for aligning the groups 11 and 11' of objects 7 deposited on the conveying surface as an imbricated formation are known to one skilled in the art. Therefore, knowing the invention he will be capable of implementing the arrangement that is shown only very schematically in FIG. 7.

FIGS. 1 to 7 and the descriptive texts belonging to them illustrate exemplary embodiments of method and arrangement in accordance with the invention, each of which comprises two step sequences belonging together for establishing object groups 11 and 11' being rotated relative to one another or means implementing the step sequences, respectively. It goes without saying that the steps contained in the individual step sequences, in particular the rotation steps A, B and/or C, may also be combined to form other step sequences leading to further embodiments of the method according to the invention, which belong to the concept of the invention of the present application in the same manner as those embodiments specifically illustrated in FIGS. 1 to 7.

All embodiments of the arrangement in accordance with the invention may also comprise a plurality of stacking devices 2. In such a case, the conveying track 3 of the supply system 1 is to extend to the zone of each stacking device, for example one after the other. For every stacking device 2 corresponding release points E and E' with control means for releasing groups of objects 7 from held conveyance and conveying devices 10 and if so required 10' for lying conveyance have to be provided. The control means of the release points function, for example, such that at a first stacking device every first (11 released at E) and third (11' released at E') one of the supplied groups are released and at a second stacking device every second (11 released at E) and fourth (11' released at E') one.

What is claimed is:

1. A method for producing cross stacks (12) from flat objects (7), wherein the objects (7) are supplied to be stacked being conveyed serially along a conveying track (3) individually held and aligned with one another and are stacked in stack sections rotated relative to one another by 180° around a stacking axis, and wherein, prior to being stacked, the objects (7) are subjected to one of a first step sequence or a second step sequence in alternating groups, wherein in both step sequences the objects (7) are released from held conveyance to be conveyed to the stacking, in at least one of the step sequences the objects are lying in an imbricated formation on a conveying surface and wherein the two step sequences together comprise at least one rotation step (A, B, C) such that there is a rotation difference of 180° around an axis perpendicular to the object surfaces between the two step sequences, and wherein the objects (7) are stacked alternatingly in groups from the first and from the second step sequence.

2. The method according to claim 1, wherein the at least one rotation step (A, B, C) is carried out during at least one of held conveyance of the objects (7), release of the objects (7) from held conveyance to lying conveyance, and lying conveyance of the objects (7).

3. The method according to claim 2, wherein the at least one rotation step (A, B, C) carried out during held conveyance of the objects (7) comprises one of conveyance along a conveying track loop (30), a conveying track twist (31), or a rotation of the held objects (7) relative to the conveying track (3).

4. The method according to claim 3, wherein the rotation of the held objects (7) relative to the conveying track is implemented by rotating a section of rail (3'), along which grippers (6) holding the objects (7) are movable, or by rotating the grippers (6) relative to the conveying track.

5. The method according to claim 2, wherein the at least one rotation step (A) carried out during release of the articles (7) from held conveyance to lying conveyance comprises transferring the objects from a substantially vertical to an essentially lying conveying position.

6. The method according to claim 2, wherein the at least one rotation step (A, B) carried out during lying conveyance of the objects comprises conveying the objects through a twist of a conveying track (31) or around a bend in a conveying track (33).

7. The method according to claim 1, wherein the rotation difference is established by a rotation step (C) in one of the rotation sequences comprising a rotation of the objects (7) by 180° around an axis perpendicular to the object surfaces.

8. The method according to claim 1, wherein the rotation difference is established by rotation steps (A, B) comprising rotations around two axes parallel to the object surfaces.

9. The method according to claim 8, wherein, of the rotations around two axes parallel to the object surfaces, at least one is carried out as a rotation step (A, A' or B, B') with opposite rotation directions in either one of the step sequences.

10. The method according to claim 1, wherein, for stacking, the objects (7) are positioned in a stacking shaft (20).

11. The method according to claim 10, wherein the objects (7) are positioned in the stacking shaft (20) in alternating groups from two opposite sides and/or on two levels located one above the other.

12. An arrangement for producing cross stacks (12) from flat objects (7) being supplied serially and uniformly aligned, said arrangement comprising a supply system (1) and a stacking device (2), wherein, for supplying the objects serially, individually held and uniformly aligned along a conveying track (3) in a conveying direction (F), the supply system (1) is equipped with grippers (6) and comprises a first release point (E) with a first release means for releasing objects (7) from held conveyance in a controlled manner, wherein the supply system (1) further comprises a second release point (E') situated at a distance downstream from the first release point (E) with a second release means for releasing objects (7), at least the first release means is controlled for releasing groups of objects and for passing other groups of objects, the arrangement further comprising at least one conveying device (10, 10')with a conveying surface (10.1, 10.2, 10'.1, 10'.2) and being arranged between one of the release points (E or E') and the stacking device (2), wherein the supply system (1) between the first and the second release point (E and E') and/or the at least one conveying device (10, 10') are arranged or are equipped with rotation means such that the objects (7), depending on their release at the first or at the second release point (E, E'), are rotated around an axis perpendicular to the object surfaces with a rotation difference of 180°.

13. The arrangement according to claim 12, wherein, between the first and second release points (E and E'), the supply system (1) comprises one of a conveying track loop (30), a conveying track twist (31), or a rail section (3') rotatable around an axis (D.1, D.2) either parallel or perpendicular to the conveying track.

14. The arrangement according to claim 12, wherein the at least one conveying device (10, 10') comprises two conveying surfaces (10.1, 10.2, 10'.1, 10'.2) and the conveying surfaces define a bend or a twist in the conveying track (33).

15. The arrangement according to claim 12, further comprising two conveying devices (10, 10'), each conveying device having a substantially horizontal conveying surface (10.1, 10'.1), and wherein the supply system (1) is equipped for suspended conveyance and the two conveying devices (10, 10') are connected with the supply system (1) such that released objects (7) are deposited on the two conveying surfaces (10.1, 10'.1) in opposite directions.

16. The arrangement according to claim 12, wherein the supply system comprises an endless circulating traction organ (32) and grippers (6) arranged on the traction organ.

17. The arrangement according to claim 12, wherein the supply system (1) comprises a stretch of rail defining the conveying track (3) and on the stretch of rail individually movable holding elements (4) with grippers (6) as well as a drive for conveying the holding elements (4) along the stretch of rail, and wherein the holding elements (4) are coupled to the drive.

18. The arrangement according to claim 12, wherein the stacking device (2) is equipped for being supplied with objects (7) to be stacked from two sides opposite one another and/or on two stacking levels arranged one above the other.

19. An arrangement for producing cross stacks (12) from serially supplied, flat objects (7), said arrangement comprising a supply system (1) and a stacking device (2), wherein, for supplying the objects (7) serially, individually held and uniformly aligned along a conveying track (3) in a conveying direction (F), the supply system (1) is equipped with grippers (6) and comprises a first release point (E) having a first release means for releasing objects (7) from held conveyance in a controlled manner, wherein the conveying track (3) of the supply system (1) is arranged above a conveying surface (10.1) that is directed towards the stacking device (2) and the release point (E) is arranged above the conveying surface, and wherein the arrangement further comprises, at the release point (E) or upstream thereof, means for rotating alternating groups of the grippers (6) in opposite directions relative to the conveying track (3) and, in the area of the release point (E), means for depositing the alternating groups of objects (7) in opposite directions on the conveying surface (10.1).

20. The arrangement according to claim 19, wherein a separate depositing means is provided for depositing the objects (7) in each opposite direction and wherein one of the release points (E, E') is assigned to each said depositing means.

* * * * *